US006134759A

United States Patent [19]

Saijo et al.

[11] Patent Number: 6,134,759

[45] **Date of Patent: *Oct. 24, 2000**

[54] APPARATUS FOR FLUID TREATMENT OF YARN AND A YARN COMPOSED OF ENTANGLED MULTIFILAMENT

[75] Inventors: Teruaki Saijo; Takao Sano; Kouji Shimada, all of Shiga, Japan

[73] Assignee: Toray Industries, Inc., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/049,370

[22] Filed: Mar. 27, 1998

[51] Int. Cl.[7] ..... D02G 1/16; D02J 1/08

[52] U.S. Cl. ..... 28/274; 28/271; 28/276

[58] Field of Search ..... 28/271, 273, 274, 28/275, 276, 254; 57/333, 350

[56] References Cited

U.S. PATENT DOCUMENTS

| | | | |
|---|---|---|---|
| 3,750,242 | 8/1973 | Lloyd et al. . | |
| 3,983,609 | 10/1976 | Pike | 28/274 |
| 4,251,904 | 2/1981 | Sano et al. | 28/274 |
| 4,355,445 | 10/1982 | Matsumoto et al. | 28/274 |
| 5,157,819 | 10/1992 | Hodan | 28/271 |
| 5,325,572 | 7/1994 | Dickson, III et al. | 28/274 |
| 5,398,392 | 3/1995 | Sano et al. | 28/276 |
| 5,857,249 | 1/1999 | Todd | 28/271 |

FOREIGN PATENT DOCUMENTS

| | | | |
|---|---|---|---|
| 116442 | 7/1984 | Japan | 28/273 |

*Primary Examiner*—Amy B. Vanatta
*Attorney, Agent, or Firm*—Austin R. Miller

[57] ABSTRACT

An apparatus for fluid treatment of yarn, which has a yarn passage and a fluid passage with a fluid outlet in the yarn passage, wherein the fluid passage has a substantially straight passage and an expanding passage existing between the end of the substantially straight passage and the fluid outlet, and that the width of the expanding passage in the direction parallel to the axial line of the yarn passage increases gradually from the end of the substantially straight passage to the fluid outlet.

12 Claims, 9 Drawing Sheets

APPARATUS FOR FLUID TREATMENT OF YARN AND A YARN COMPOSED OF ENTANGLED MULTIFILAMENT

BACKGROUND OF THE INVENTION

The present invention relates to an apparatus for fluid treatment of yarn by forcing fluid into a running multifilament yarn, for specially entangling multifilaments. It further relates to a yarn composed of entangled multifilaments produced by the apparatus.

Multifilament yarn produced by a high molecular polymer generally has is poor filament coherency, requiring treatment to impart coherency. Conventional methods for imparting coherency include twisting the yarn, sizing the yarn, and fluid entanglement.

Fluid entanglement is often used, because it is easy to impart desired properties of compactness or bulkiness to the yarn as spun. The requisite equipment is simple.

Fluid entangling devices are often called entangling devices, entangling nozzles or interlacing nozzles, etc.

The conventional entangling nozzle comprises a nozzle block, a yarn passage formed in the nozzle block and having a yarn inlet and a yarn outlet in the outer surface of the nozzle block, and also a fluid passage formed in the nozzle block and having a fluid inlet in the outer surface of the nozzle block and a fluid outlet in the inner wall surface of the yarn passage.

The yarn is run at a desired speed and tension, through the yarn passage, and encounters a fluid (fluid jet) injected at a desired pressure, velocity and flow rate from the fluid passage. This causes the filaments constituting the yarn, to be displaced relatively each other and entangled, and a yarn composed of entangled filaments is produced.

The yarn is simply called a tangled yarn. Depending on the treatment conditions selected, a compact yarn or a bulky yarn can be produced. An entanglement measuring instrument for measuring the degree of entanglement of filaments is known and used. Also, a bulkiness measuring instrument is used for that purpose.

To improve the entangling capability of the entangling nozzle, various nozzles and methods have been proposed.

For example, an entangling nozzle in which a cross-sectional configuration and area of the yarn passage are changed in the longitudinal direction has been proposed. Furthermore, to obtain a high degree of entanglement, it has been proposed to force a compressive fluid of higher than the critical pressure through a fluid passage at a supersonic velocity with a specially formed cross section to a running yarn.

These proposals are disclosed in Japanese Patent Laid-Open (Kokai) Nos. 54-30952 and 48-1340 and Japanese Patent Publication No. 36-10511.

These conventional entangling nozzles have a narrow throat in the cross section of the fluid passage, which increases the velocity of the fluid, in order to achieve a high degree of entanglement.

However, since the fluid passage is a thin or fine hole having a diameter of only several millimeters, it is very difficult to form a highly accurate throat in the hole. Accordingly, the entangling capability differs from nozzle to nozzle among the many nozzles produced. As a result, it is an inevitable problem that the entangling capability and degree of yarn entanglement differs from nozzle to nozzle among many entangling nozzles used in a production.

SUMMARY OF THE INVENTION

The object of the present invention is to provide an apparatus for tangling multifilament yarn with manufacturing consistency and accuracy, and produce a plurality of yarns composed of entangled multifilaments with small variance of entangling degree from yarn to yarn.

The apparatus for fluid treatment of yarn according to the present invention will be described with reference to specific forms of the invention selected for illustration in the drawings, which are not intended to define or to limit the scope of the invention, which is defined in the appended claims.

DESCRIPTION OF THE PREFERRED EMBODIMENTS

Turning first to FIGS. 1–6, an apparatus 1 for fluid treatment of yarn is formed by a nozzle block (NB). The nozzle block NB comprises five pieces. A right piece 2*a* and a left piece 2*b* are positioned with a predetermined space between them. A bottom piece 3, a top front piece 4*a* and a top rear piece 4*b* are positioned between the right and left pieces 2*a* and 2*b*. The bottom piece 3 and the top front and rear pieces 4*a* and 4*b* are positioned with a space between them. These five pieces are coupled by any proper coupling means such as screws or adhesive, not illustrated.

The yarn passage Yp is formed as a space surrounded by the surfaces of the right and left pieces 2*a* and 2*b*, the bottom piece 3 and the top front and rear pieces 4*a* and 4*b*. One of the front and rear openings of the yarn passage Yp in the outer surface of the nozzle block NB is the yarn inlet Iy, and the other is the yarn outlet Oy.

The fluid passage Fp is formed as a space surrounded by the surfaces of the right and left pieces 2*a* and 2*b* and the top front and rear pieces 4*a* and 4*b*. The opening of the fluid passage Fp in the outer surface of the nozzle block NB is the fluid inlet If of the fluid passage Fp, and the opening of the fluid passage Fp in the inner wall surface of the yarn passage Yp is the fluid outlet Of of the fluid passage Fp.

The fluid passage Fp has a straight passage Sp and an expanding passage Ep.

The straight passage Sp is formed in such a manner that the area and configuration of the fluid passage Fp in the section crossing the axial line of the fluid passage Fp are kept constant in a predetermined range along the axis of the fluid passage Fp.

Where the axis of the straight passage Sp is the first axial line ASp (FIG. 4), the axial line of the yarn passage Yp is the second axial line AYp, a line parallel to the second axial line AYp is the reference line APYp, and the plane containing the first axial line ASp and the reference line APYp is the reference plane BP (FIG. 3), then the expanding passage Ep (FIG. 1) is formed in such a manner that the width WaFp (FIG. 4) of the fluid passage Fp gradually increases in a range from the end of the straight passage Sp to the fluid outlet Of in the reference plane BP.

In this embodiment, the width WaFp of the fluid passage Fp gradually increases along a smooth curve to form the expanding passage Ep.

The fluid jet (which ray be a air, for example) is supplied into the fluid passage Fp of the fluid treating device 1 by a fluid pipe (not illustrated) connected, at one end, to a fluid jet source and, at the other end, to the fluid inlet If. The running yarn enters the yarn passage Yp from the yarn inlet Iy and encounters the fluid jet on the way, and is taken out from the yarn outlet Oy.

Figure 1:
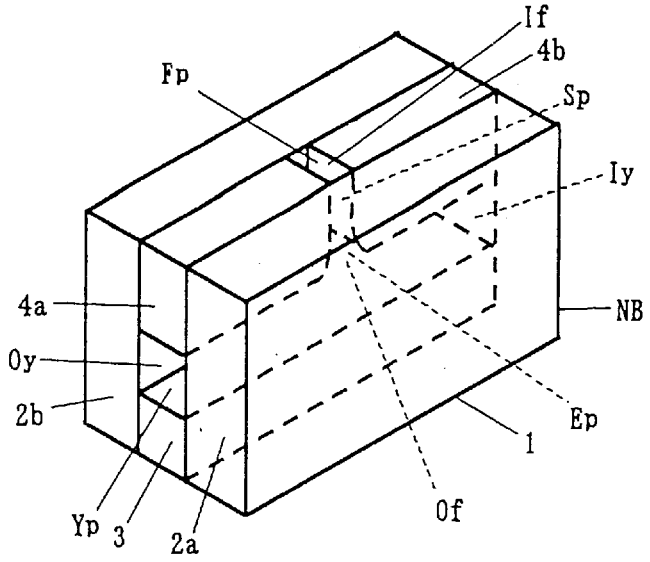
FIG. 1 is a schematic perspective view showing an example of the apparatus of the present invention.
Figure 2:
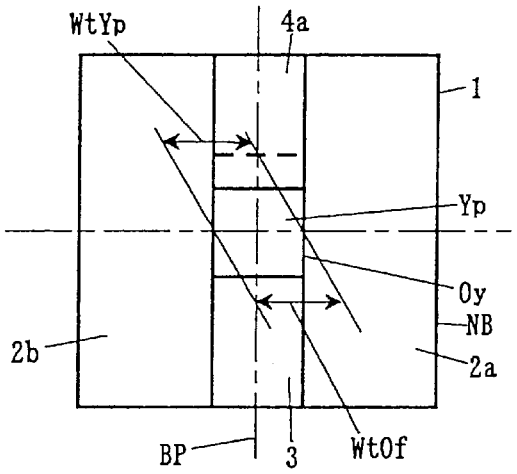
FIG. 2 is a front view of the apparatus shown in FIG. 1.
Figure 3:
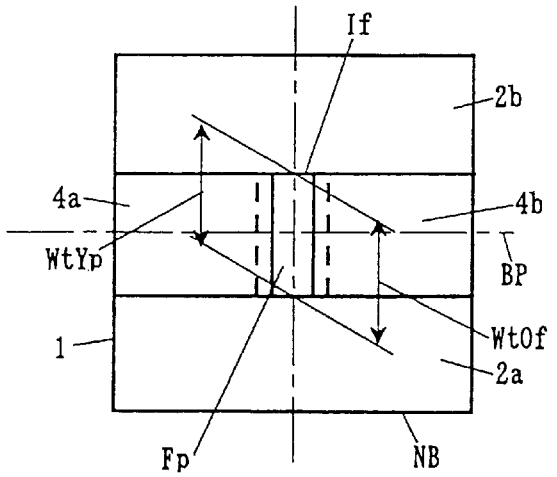
FIG. 3 is a top view of the apparatus shown in FIG. 1.
Figure 4:
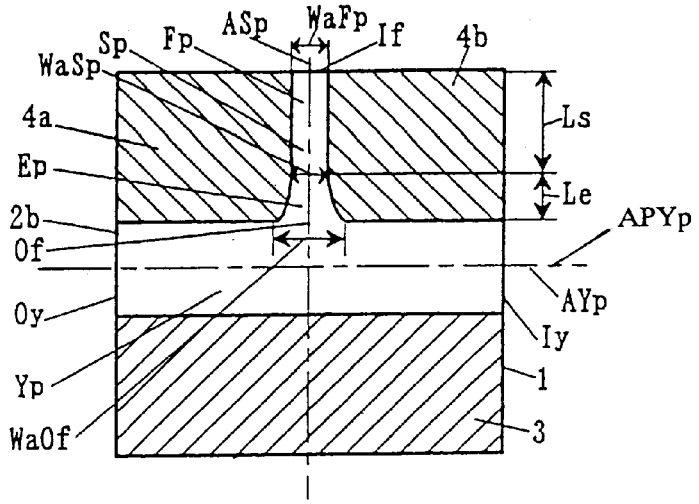
FIG. 4 is a vertical sectional view of the apparatus shown in FIG. 1.
Figure 5:
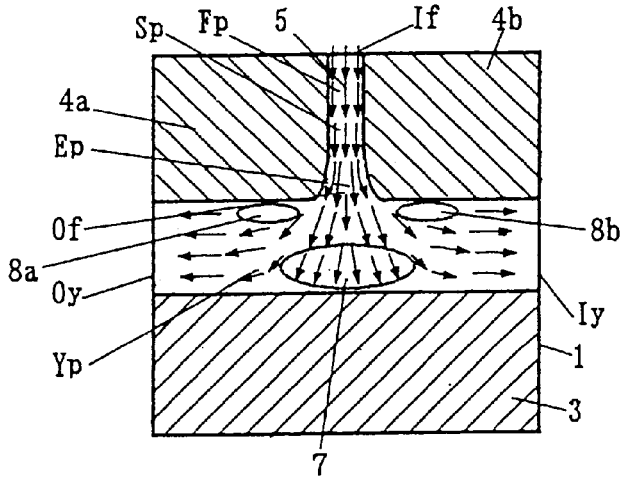
FIG. 5 is a vertical sectional view typically showing fluid flow in the fluid jet shown in FIG. 1.
Figure 6:
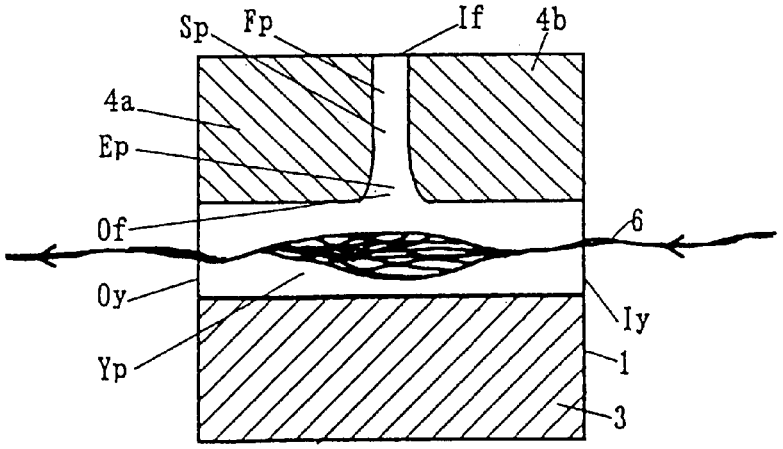
FIG. 6 is a vertical sectional view showing typically entanglement of a yarn in the apparatus of FIG. 1.

Referring to FIGS. 5 and 6, the fluid jet 5 entering the fluid passage Fp from the fluid inlet If passes through the straight passage Sp and further through the expanding passage Ep and is ejected from the fluid outlet Of into the yarn passage Yp, to impinge upon the yarn 6 running in the yarn passage Yp.

In this case, the flow of the fluid jet 5 is controlled by the straight passage Sp in the jet direction, and since the expanding passage Ep is downstream of the straight passage Sp, the fluid flow is expands in a direction parallel to the reference line APYp (FIG. 4) (the second axial line AYp) in the area near the fluid outlet Of. So, in the space near the wall surface of the yarn passage Yp facing the fluid outlet Of, a high pressure portion 7 (FIG. 5) is formed, and in the space near the wall surface of the yarn passage Yp near the fluid outlet Of, low pressure portions 8*a* and 8*b* (FIG. 5) are formed.

It was found that when the running yarn 6 passes the high pressure portion 7 and the low pressure portions 8*a* and 8*b*, the filaments 6 are entangled far more efficiently than heretofore.

In the FIGS. 1–6 embodiment of the invention, the maximum width WtOf (FIG. 3) of the fluid outlet Of (the end of the expanding passage Ep) of the fluid passage Fp in the direction perpendicular to the reference plane BP is substantially equal to the maximum width WtYp (FIG. 3) of the yarn passage Yp. In this embodiment, the reference line ApYp agrees with the second axial line AYp.

In this embodiment, the configuration of the fluid passage Fp in a plane vertical to the reference plane BP and parallel to the direction of the reference line APYp (the second axial line AYp) is rectangular, and the configuration of the yarn passage Yp in a plane perpendicular to the reference plane BP and perpendicular to the direction of the reference line APYp (the second axial line AYp) is rectangular.

The apparatus accordingly comprises a nozzle block (NB), a yarn passage (Yp) formed in the nozzle block (NB) and having a yarn inlet (Iy) and a yarn outlet (Oy) in the outer surface of the nozzle block (NB), and a fluid passage (Fp) formed in the nozzle block (NB) and having a fluid inlet (If) in the outer surface of the nozzle block (NB) and a fluid outlet (Of) in the inner wall surface of the yarn passage (Yp), wherein the fluid passage (Fp) comprises a straight passage (Sp), and an expanding passage (Ep), and wherein (i) the straight passage (Sp) is formed in such a manner that the area and formed of the fluid passage (Fp) in the section crossing the axial line of the fluid passage (Fp) are constant in a desired range in the axial direction of the fluid passage (Fp), and (ii) the expanding passage (Ep) is formed in such a manner that a width (WaFp) of the fluid passage (Fp) in the direction parallel to a reference line (APYp) is gradually increased in a range from the end of the straight passage (Sp) to the fluid outlet (Of) on a reference plane (BP), where the reference line (APYp) is a line parallel to a second axial line (AYp); the reference plane (BP) is a plane containing a first axial line (ASp) and the reference line (APYp); the first axial line (ASp) is the axial line of the straight passage (Sp); and the second axial line (AYp) is the axial line of the yarn passage (Yp).

Since the fluid passage (Fp) of this apparatus (entangling nozzle) has a straight passage (Sp) with a certain length and an expanding passage (Ep) in succession to it, a high pressure portion is formed in the space in contact with the wall surface of the yarn passage (Yp) facing the fluid outlet (Of) of the fluid passage (Fp) and its vicinity, and low pressure portions are formed in the space in contact with the wall surface of the yarn passage (Yp) near the fluid outlet (Of) of the fluid passage (Fp) and its vicinity, which enhances the filament entangling capability.

Figure 7:
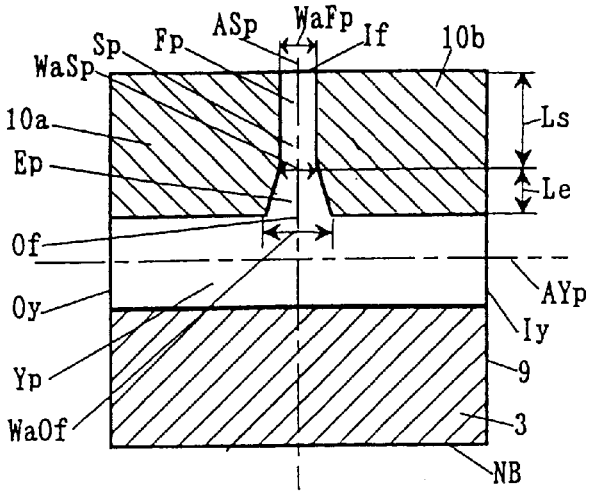
FIG. 7 is a vertical sectional view showing an alternative embodiment of the apparatus of the present invention.

In the FIG. 7 embodiment of the apparatus of the present invention, a top front piece 10*a* and a top rear piece 10*b* are provided with a straight portion, i.e., tapered portion as the face forming the expanding passage Ep, instead of a curve as in the FIGS. 1–6 example. The other portions are the same, and FIG. 7 structure assures a similar action. The FIG. 7 example is easier to manufacture regarding the expanding passage Ep portion, and is higher in manufacturing accuracy and somewhat less costly.

The maximum passage width (WtOf) at the fluid outlet (Of) of the expanding passage (Ep) in the direction perpendicular to the reference plane (BP) is substantially equal to the maximum passage width (WtYp) of the yarn passage (Yp).

In this case, the accuracy in manufacturing the entangling nozzle is further improved, and even if many entangling nozzles are manufactured and used in the same plant, all the entangling nozzles obtained have substantially the same entangling capability.

The length (Ls) of the straight passage (Sp) in the direction of the first axial line (ASp) in the reference plane (BP), the width (WaSp) at the end of the straight passage (Sp) in the direction parallel to the reference line (APYp), the length (Le) of the expanding passage (Ep) in the direction of the first axial line (ASp) and the width (WaOf) of the fluid outlet (Of) in the direction parallel to the reference line (APYp) in the reference plane (BP) satisfy the following fomulae (I) and (II):

$$Ls>Le>2\times WaSp \quad \text{(I)}$$

$$0^\circ<\tan^{-1}\{(WaOf-WaSp)/(2\times Le)\}<20^\circ \quad \text{(II).}$$

Where these formulae are not satisfied, the following phenomena may occur.

Where the condition of the formula (I) is not satisfied, i.e., where $Ls \leqq Le$, the straight progression of the fluid jet by the straight passage (Sp) may become weak, and in this case, the above-mentioned action and effect by the expanding passage (Ep) existing next to the straight passage (Sp) may decrease.

Where the latter condition of the formula (I) is not satisfied, i.e., where $Le \leqq 2\times WaSp$, the effect of expanding the passage of the fluid jet by the expanding passage (Ep) may become weak. In this case, the above-mentioned action and effect by the expanding passage (Ep) nay decrease.

Furthermore, where the latter condition of the formula (II) is not satisfied, i.e., where $\tan^{-1}\{(WaOf-WaSp)/(2\times Le)\}$ (this term is expressed by T)$\leqq 20^\circ$ C., the fluid jet may flow only toward the yarn inlet (Iy) or yarn outlet (Oy) of the yarn passage (Yp), and in this case, the filament entangling action by the fluid jet declines. In the formula (II), $T \leqq 15^\circ$ is more preferable.

Where the reference line (APYp) agrees with the second axial line (AYp), the entangling nozzle can be more easily manufactured, and the manufacturing accuracy can be further improved.

Where the form of the fluid passage (Fp) in a plane perpendicular to the reference plane (BP) and parallel to the direction of the reference line (APYp) is rectangular and the configuration of the yarn passage (Yp) in a plane perpendicular to the reference plane (BP) and perpendicular to the direction of the reference line (APYp) is rectangular, the entangling nozzle can be more easily manufactured, and the manufacturing accuracy can be further enhanced. Furthermore, the entangling nozzle can also be easily assembled and disassembled for repairing.

Where the area of the yarn passage (Yp) in a plane perpendicular to the second axial line (AYp) expands at least at either of the yarn inlet portion containing the yarn inlet (Oy) or the yarn outlet portion containing the yarn outlet (Oy), the discharge of the fluid contributed to the entangling treatment from either of or both of the yarn inlet (Iy) and the yarn outlet (Oy) can be promoted. Furthermore, in this relationship, where the treatment conditions are properly selected, the entanglement of filaments becomes bulky, and in this case, the entangling nozzle can be applied to the production of a bulky yarn.

Where the fluid passage (Fp) has (i) a straight passage (Sp) in which a first distance (LSp) is constant in a desired range in the direction toward the fluid outlet (Of) of the fluid passage (Fp), where the first distance (LSp) is a distance in the direction of a first perpendicular (AtFp) from a first axial line (AFp) to the wall surface of the fluid passage (Fp); the first perpendicular (AtFp) is a line perpendicular to the first axial line (AFp); and the first axial line (AFp) is the axial line of the fluid passage (Fp), and (ii) an expanding passage (Ep) in which a second distance (LEp) gradually increases in a range from the downstream end of the straight passage (Sp) to the fluid outlet (Of) either on the yarn inlet (Iy) side or on the yarn outlet (Oy) side, where the second distance (LEp) is a distance in the direction of a second perpendicular (AtBP) from a first axial line (AFp) to the wall surface of the fluid passage (Fp); the second perpendicular (AtBP) is a line perpendicular to the first axial line (AFp) in a reference plane (BP); the first axial line (AFp) is the axial line of the straight passage (Sp); the reference plane (BP) is a plane containing the first axial line (AFp) and a reference line (APYp); the reference line (APYp) is a line parallel to a second axial line (AYp); and the second axial line (AYp) is the axial line of the yarn passage (Yp), the major portion of the FIGS. 1–6 embodiment of the invention are reflected, and both embodiments are substantially the same.

It will accordingly be understood that in many forms of the invention, the entangled yarn has filaments entangled each other in good balance, and as desired. Furthermore, the entangled yarns are substantially free from dispersion in entanglement.

In the present invention, expressions relating to the axial line of the fluid passage Fp, the axial line of the straight passage Sp and the axial line of the yarn passage Yp refer to lines passing through the centers of gravity of the figures formed by the cross sections of the respective passages.

In the apparatus of the present invention, it is preferable to form the expanding passage Ep of the fluid passage Fp with a plurality of members. In this case, the manufacturing accuracy of the expanding passage Ep can be improved.

In the apparatus of the present invention, the wall surface configuration of the expanding passage Ep of the fluid passage Fp in the reference plane BP can be curved, tapered, stepped or formed in any other way, but it is preferable that it is formed in such a manner as to gradually and smoothly depart from the first axial line.

In the apparatus of the present invention, the sectional configuration of the yarn passage Yp in the direction perpendicular to the axial line of the yarn passage Yp (the second axial line AYp) can be circular, imperfectly circular, semi-circular, oblong, ellipsoidal, triangular, square, polygonal or of any other form.

In the apparatus of the present invention, the sectional configuration of the fluid passage Fp in the direction perpendicular to the axial line of the straight passage Sp (the first axial line ASp) can be various, but since it is small in diameter, a rectangle or circle is preferable.

In the apparatus of the present invention, the number of fluid passages Fp can be one, two, three or many, and are not limited. The number of fluid passages Fp is determined in relation to the kind of the yarn to be entangled, the desired type of filament entanglement and the magnitude of the energy of the fluid jet.

In the apparatus of the present invention, it is preferable that the angle formed by the axial line of the straight passage Sp of the fluid passage Fp (the first axial line ASp) and the axial line of the yarn passage Yp (the second axial line AYp) or the reference line APYp is about 30° to 150°. To obtain a high degree of entanglement, an angle of about 60° to 120° is preferable, and about 90° is more preferable. For obtaining bulky filament entanglement, an angle of about 10° to 60° is preferable.

For the cross-sectional configuration of the yarn passage Yp, the cross-sectional configuration and number of the fluid passages Fp, and the angle formed by the axial line of the straight passage Sp of the fluid passage Fp (the first axial line ASp) and the axial line of the yarn passage Yp (the second axial line AYp) or the reference line APYp, U.S. Pat. No. 4,251,904 (EP-A-11,441) can be referred to.

In the apparatus of the present invention, the material of the members used to form the yarn passage Yp and the fluid passage Fp can be any material which is durable in the presence of the running yarn and the fluid jet, and may be metal, ceramics, glass or any other material coated with a hard film.

The fluid jet used can be any fluid jet of the kind usually used for producing conventional entangled yarns. The fluid jet can be at room temperature or heated compressed air or steam, etc. The fluid jet is supplied to the fluid passage Fp by a fluid jet supply pipe connected to a supply source at one end and to the fluid inlet If of the fluid passage Fp at the other end.

The fomulae (I) and (II) have been described in reference to the above-described embodiments.

Where the following items (a) through (d) satisfy the fomulae (I) and (II), the action of the expanding passage Ep described above in the device can be secured more reliably.

In the formulae the letter (a) designates the length Ls (FIGS. 4 and 7) of the straight passage Sp in the direction of the first axial line ASp (FIGS. 4 and 7) in the reference plane BP (FIGS. 2 and 3), (b) designates the width WaSp (FIGS. 4 and 7) at the end of the straight passage Sp in the direction parallel to the reference line APYp (the second axial line AYp) (FIGS. 4 and 7) in the reference plane BP, (c) designates the length Le (FIGS. 4 and 7) of the expanding passage Ep in the direction of the first axial line ASp in the reference plane BP, and (d) designates the width WaOf (FIGS. 4 and 7) of the fluid outlet Of in the direction parallel to the reference line APYp (the second axial line AYp) in the reference plane BP.

Figure 8:
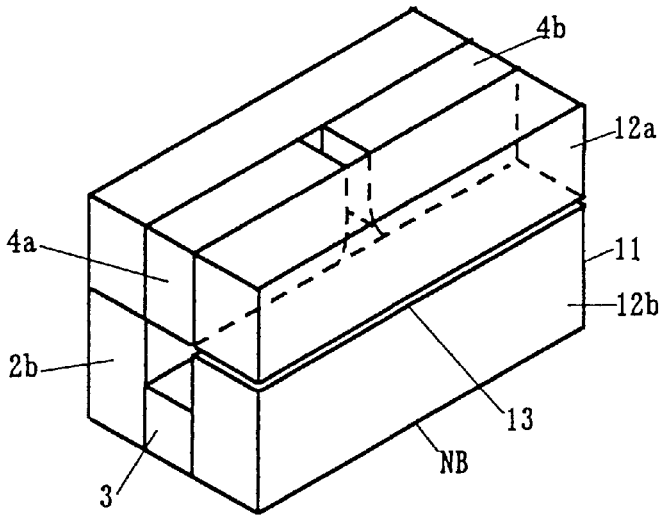
FIG. 8 is a perspective view showing another embodiment of the apparatus of the present invention.

FIG. 8 is a perspective view showing another embodiment of the invention in which the right-hand piece is divided into top and bottom right pieces 12*a,* 12*b* with a threading slit between them for easier yarn threading into the yarn passage Yp of the FIGS. 1–6 embodiment. The other portions of this embodiment are the same.

Figure 9:
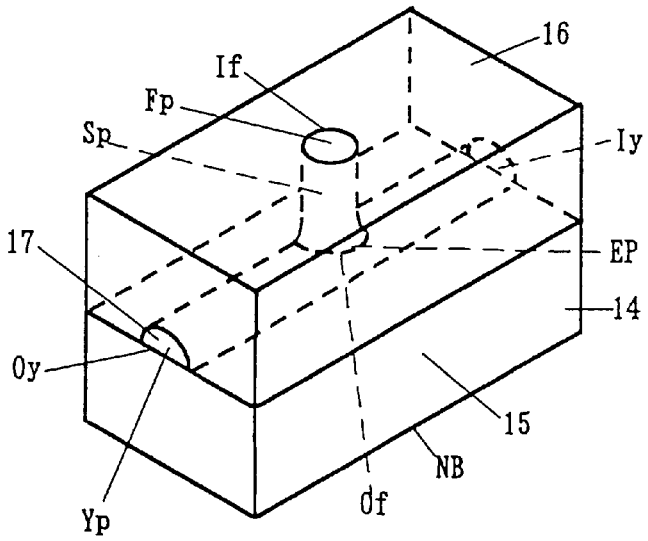
FIG. 9 is a perspective view showing still another embodiment of the apparatus of the present invention.
Figure 10:
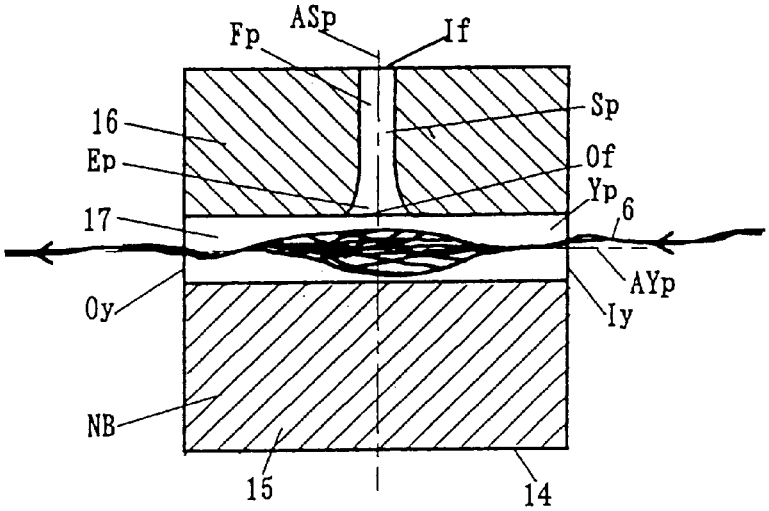
FIG. 10 is a vertical sectional view of the apparatus of FIG. 9, showing typically entanglement of yarn.
Figure 11:
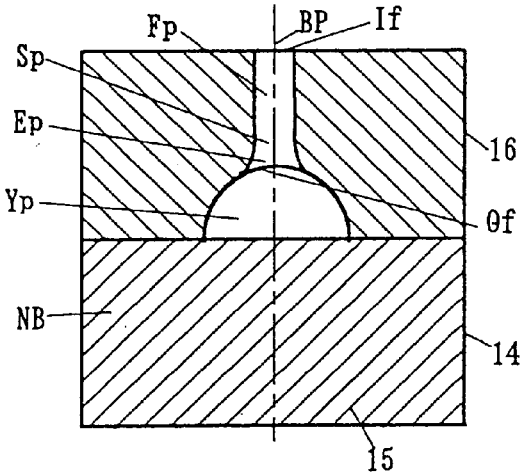
FIG. 11 is a sectional view of the apparatus shown in FIG. 9.

Referring now to FIGS. 9, 10 and 11, the nozzle block NB comprises two pieces. On a base piece 15, a nozzle piece 16 is attached. In the bottom face of the nozzle piece 16, a groove 17 having semi-circular cross section is formed. When the nozzle piece 16 is overlaid on the base piece 15, the groove 17 forms the yarn passage Yp. The nozzle piece 16 has the fluid passage Fp formed in it. The fluid inlet If of the fluid passage Fp is opened at the top of the nozzle piece 16 and the fluid outlet Of is opened in the top wall surface of the yarn passage Yp.

The fluid passage Fp has the straight passage Sp with a desired length and the expanding passage Fp ranging from the end of the straight passage Sp to the fluid outlet Of. The expanding passage Ep in FIGS. 9–11 gradually expands in the entire circumference from the end of the straight passage Sp, and the wall surface of the expanding passage Ep in the direction of the axial line ASp of the straight passage Sp forms a smooth curve.

Also in FIGS. 9–11, the fluid jet supplied into the fluid passage Fp passes through the straight passage Sp and is injected from the expanding passage Ep into the yarn passage Yp. The injected jet entangles the filaments constituting the yarn 6 running in the yarn passage Yp.

Advantages of the FIGS. 9–11 embodiment are that the number of pieces constituting the nozzle block NB can be two and that the expanding passage Ep formed by machining the wall surface of the groove 17 can be easily machined, to assure a good manufacturing accuracy in the formation of the expanding passage Ep.

Figure 12:
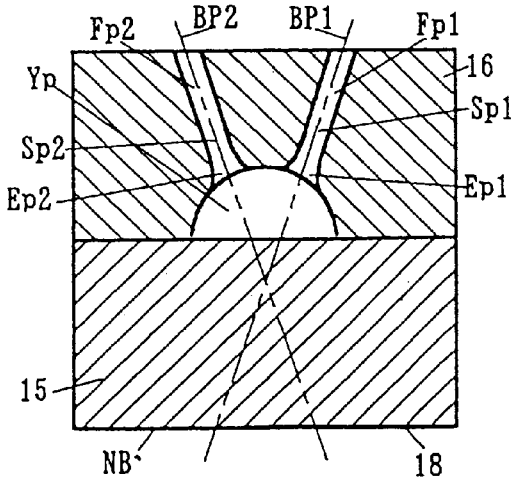
FIG. 12 is a sectional view showing still another embodiment of the apparatus of the present invention.

FIG. 12 is a cross-sectional view showing the nozzle block NB that has two fluid passages Fp1 and Fp2. The fluid passage Fp1 has a straight passage Sp1 and an expanding passage Ep1, and the fluid passage Fp2 also has a straight passage Sp2 and an expanding passage Ep2.

Figure 13:
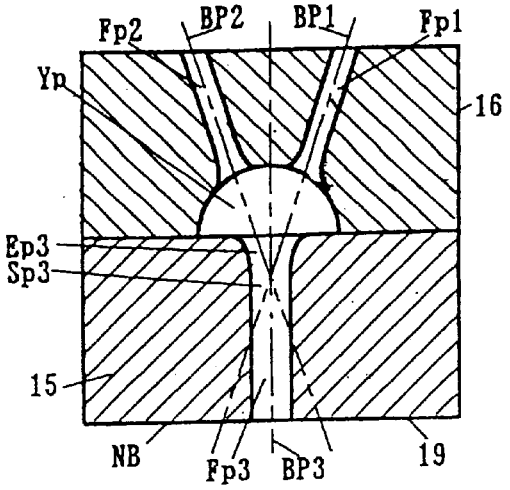
FIG. 13 is a cross sectional view showing another embodiment of the apparatus of the present invention.

FIG. 13 shows a fluid treating device 19 formed by a nozzle block NB with still another fluid passage Fp3 formed in addition to those in FIG. 12. The fluid passage Fp3 is formed in the base piece 15 and injects a fluid jet from below to oppose the fluid jets injected from the downwardly directed fluid passages Fp1 and Fp2. The fluid passage Fp3 also has a straight passage Sp3 and an expanding passage Ep3 unlike the conventional entangling nozzle. For the straight passage Sp3, a reference plane BP3 exists. By adjusting the injecting states of the fluid jets from the fluid passages Fp1, Fp2 and Fp3, high pressure areas and low pressure areas as explained (of the kind illustrated in FIG. 5) are formed.

Figure 14:
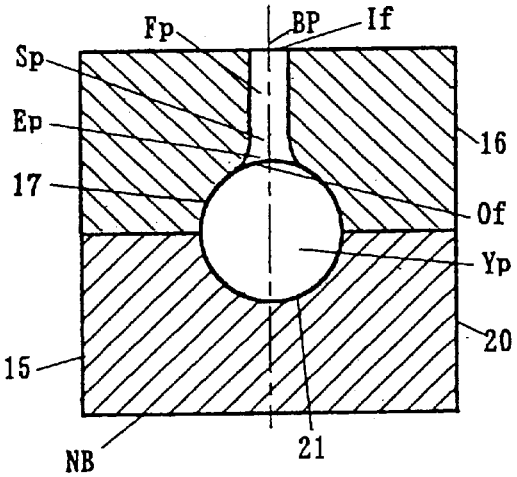
FIG. 14 is a cross sectional view showing another embodiment of the apparatus of the present invention.

FIG. 14 shows a nozzle block NB with a yarn passage Yp having circular cross-section, instead a semi-circular cross section. In the top surface of the base piece 15, a groove 21 identical in form and size with the groove 17 formed in the nozzle piece 16 is formed.

Figure 15:
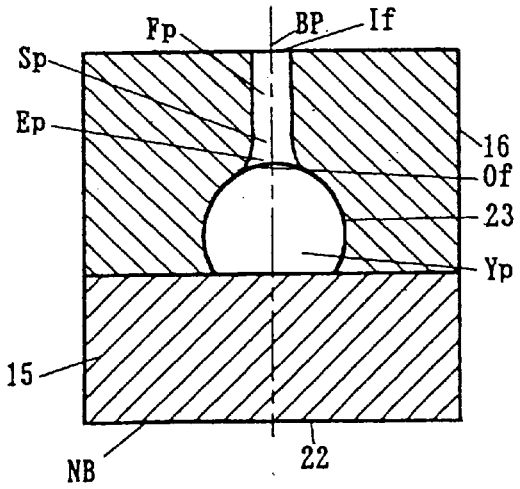
FIG. 15 is a cross-sectional view showing still another embodiment of the apparatus of the present invention.

FIG. 15 shows an apparatus for fluid treatment of yarn 22 for a yarn formed by a nozzle block NB with a yarn passage Yp having a truncated circular cross section formation, intermediate between the semi-circular form and the circular form. In the bottom surface of the nozzle piece 16, an imperfectly circular groove 23 is formed.

Figure 16:
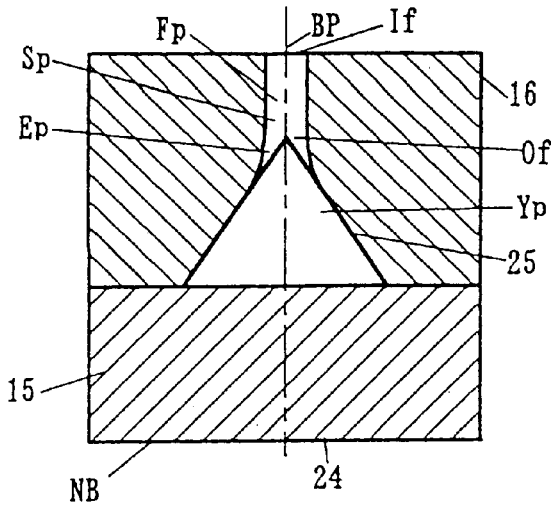
FIG. 16 is a cross-sectional view showing yet another embodiment of the apparatus of the present invention.

FIG. 16 shows a yarn passage Yp having a triangular cross section. In the bottom face of the nozzle piece 16, a triangular groove 25 is formed.

Figure 17:
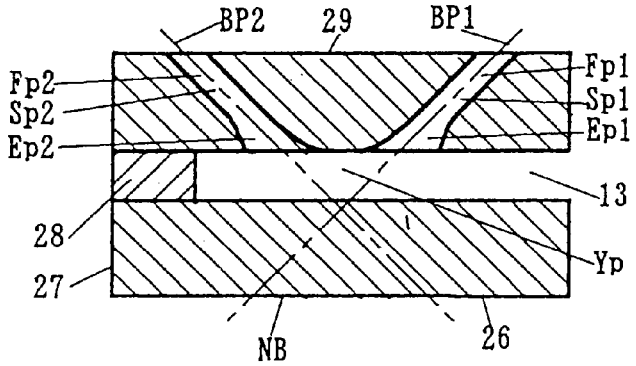
FIG. 17 is a cross-sectional view showing further still another embodiment of the apparatus of the present invention.

FIG. 17 shows a base piece 27, an intermediate piece 28 and a nozzle piece 29. Secured on the base piece 27, the intermediate piece 28 is placed, and on the intermediate piece 28, the nozzle piece 29 is placed. The space surrounded by the top surface of the base piece 27, the right-hand side face of the intermediate piece 28 and the bottom surface of the nozzle piece 29 and extending in the longitudinal direction of the nozzle block NB is the yarn passage Yp. The right-hand side of the yarn passage Yp is opened in the outer surface of the nozzle block NB. The opening is a yarn threading slit 13.

The nozzle piece 29 has a fluid passage Fp1 and a fluid passage Fp2 formed in it. The fluid passage Fp1 has a straight passage Sp1 and an expanding passage Ep1, and the fluid passage Fp2 also has a straight passage Sp2 and an expanding passage Ep2.

For the straight passage Sp1, a reference plane BP1 exists, and for the straight passage Sp2, a reference plane BP2 exists.

Figure 18:
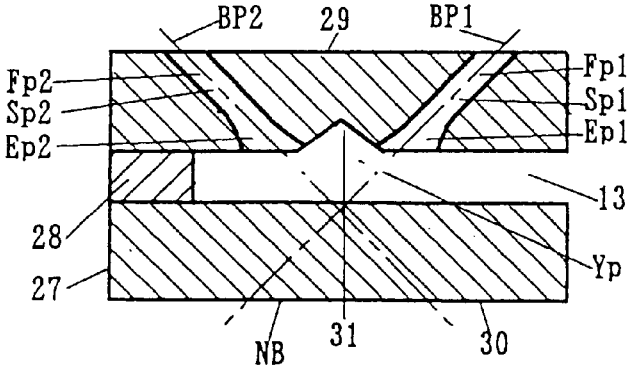
FIG. 18 is a cross-sectional view showing further still another embodiment of the apparatus of the present invention.

FIG. 18 shows a yarn passage Yp modified in the cross-sectional form. In the bottom surface of the nozzle piece 29 at an intermediate position between the fluid passages Fp1 and Fp2, a groove 31 having a triangular cross section is formed.

Figure 19:
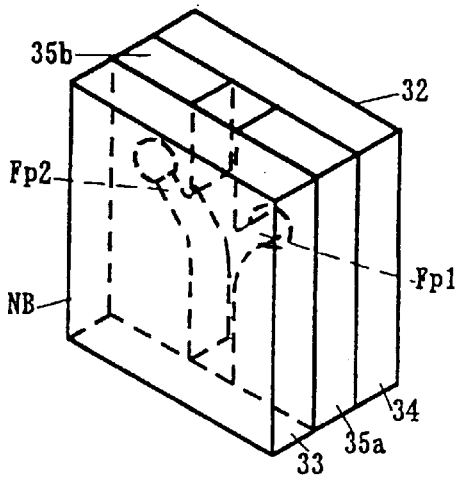
FIG. 19 is a perspective view showing another embodiment of the apparatus of the present invention.
Figure 20:
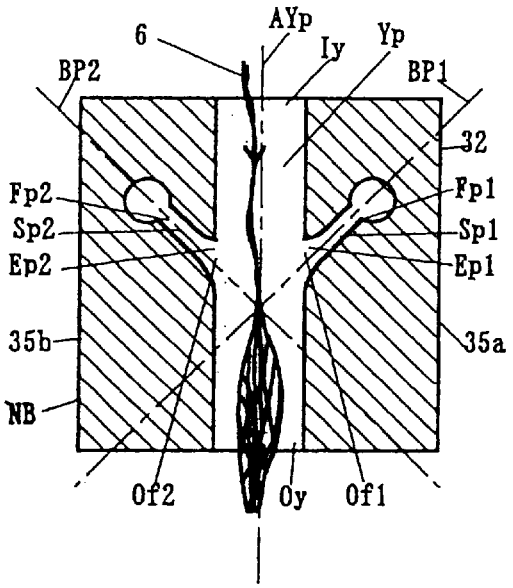
FIG. 20 is a vertical sectional view of the apparatus of FIG. 19, where typical entanglement of yarn is also shown.

In FIGS. 19 and 20, the fluid treating device 32 for a yarn is formed by a nozzle block NB comprising four pieces. A front piece 33 and a rear piece 34 are positioned with a space kept between them. An intermediate right piece 35*a* and an intermediate left piece 35*b* are secured between the front piece 33 and the rear piece 34. The intermediate right piece 35*a* and the intermediate left piece 35*b* are positioned with a space kept between them.

The yarn passage Yp of the nozzle block NB is formed as a space surrounded by the four pieces. The nozzle block NB has two fluid passages formed in it.

One fluid passage Fp1 is formed in the intermediate right piece 35*a,* and its fluid opening Of1 is positioned in the wall surface of the yarn passage Yp. The fluid passage Fp1 extends in the rear piece 34, and in the rear surface thereof, the fluid inlet If1 of the fluid passage Fp1 is formed.

The other fluid passage Fp2 is formed in the intermediate left piece 35*b,* and its fluid outlet Of2 is positioned in the wall surface of the yarn passage Yp. The fluid passage Fp2 extends in the rear piece 34, and in the rear surface thereof, the fluid inlet If2 of the fluid passage Fp2 is formed.

The fluid passage Fp1 has a straight passage Sp1 and an expanding passage Fp1 in succession. The fluid passage Fp2 has a straight passage Sp2 and an expanding passage Ep2 in succession.

The yarn running in the yarn passage Yp receives entanglement treatment by the fluid jets injected from the fluid passages Fp1 and Fp2.

Figure 21:
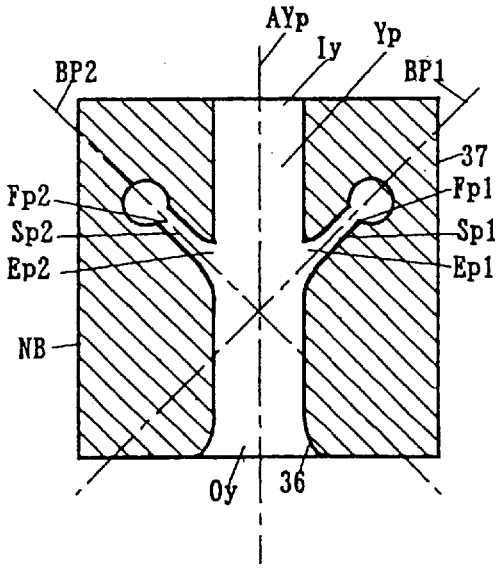
FIG. 21 is a cross-sectional view showing another embodiment of the apparatus of the present invention.

FIG. 21 shows an expanding outlet 36 expanding in the entire circumference at the yarn outlet Oy of the yarn passage Yp.

The expanding outlet 36 of the fluid treating device 37 acts to promote the discharge of the fluid jets used for entangling the filaments, from the yarn outlet Oy of the yarn passage Yp. The yarn inlet Iy portion of the yarn passage Yp may be expanding, or both the yarn outlet Oy portion and the yarn inlet Iy portion may be expanding. However in this embodiment, since the fluid passages Fp1 and Fp2 are formed obliquely toward the yarn outlet Oy, it is preferable that the yarn outlet Oy portion expands.

The expansion of the yarn passage Yp at the yarn inlet Iy portion and/or the yarn outlet Oy portion is effective to achieve bulky entanglement of the filaments.

Figure 22:
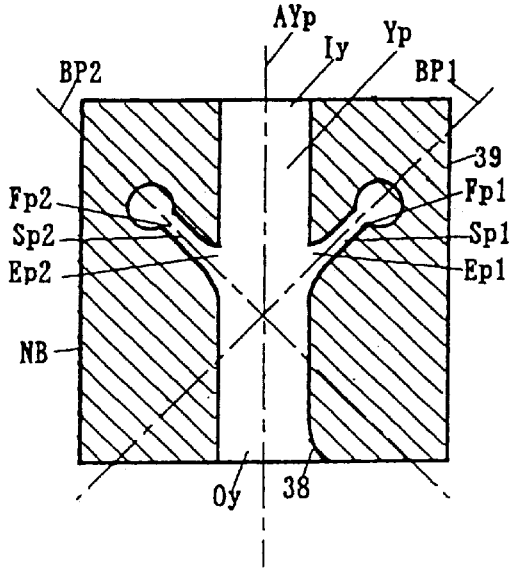
FIG. 22 is a cross-sectional view showing still another embodiment of the apparatus of the present invention.

FIG. 22 shows an expanding outlet 38 expanding only in half the circumference instead of expanding in the entire circumference at the yarn outlet Oy portion of the yarn passage Yp. The expanding outlet 38 expanding only in half the circumference also acts to promote the discharge of the fluid jets from the yarn outlet Oy, and acts to make the filaments of the yarn entangled bulkily.

Depending on the type of entangled yarn desired to be produced, selections are made whether the yarn inlet Iy portion or yarn outlet Oy portion of the yarn passage Yp is to expand. Selections are also made regarding the degree of expansion.

Figure 23:
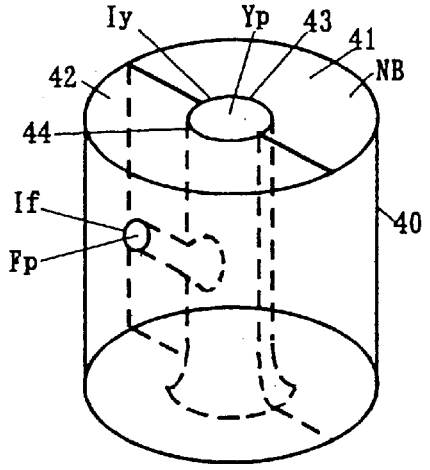
FIG. 23 is a perspective view showing further still another embodiment of the apparatus of the present invention.
Figure 24:
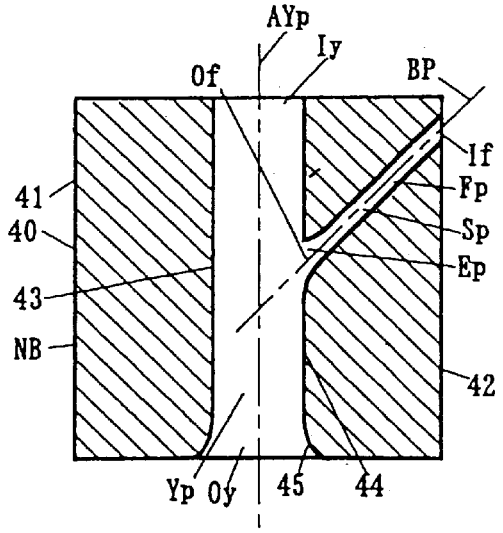
FIG. 24 is a vertical sectional view of the apparatus of FIG. 23.

FIGS. 23 and 24 shows a fluid treating device 40 for a yarn in two pieces: a base piece 41 and a nozzle piece 42 secured thereto. The entire shape is cylindrical. In the flat surface of the base piece 41, a groove 43 having semi-circular cross section is formed. In the flat surface of the nozzle piece 42, a groove 44 having semi-circular cross section is formed.

The grooves 43 and 44 facing each other form a yarn passage Yp having circular configuration in cross section. The nozzle piece 42 has a fluid passage Fp formed in it. The fluid inlet If of the fluid passage Fp is formed in the curved outer surface of the nozzle piece 42, and the fluid outlet Of is formed in the wall surface of the yarn passage Yp. The yarn outlet Of portion of the yarn passage Yp is formed as an expanding outlet 45 expanding in the entire circumference. The fluid passage Fp has a straight passage Sp and an expanding passage Ep in succession to it.

A substantial difference between the embodiment of FIGS. 23 and 24 and the embodiment of FIG. 21 is that the former has only one fluid passage Fp, while the latter has two fluid passages Fp.

Figure 25:
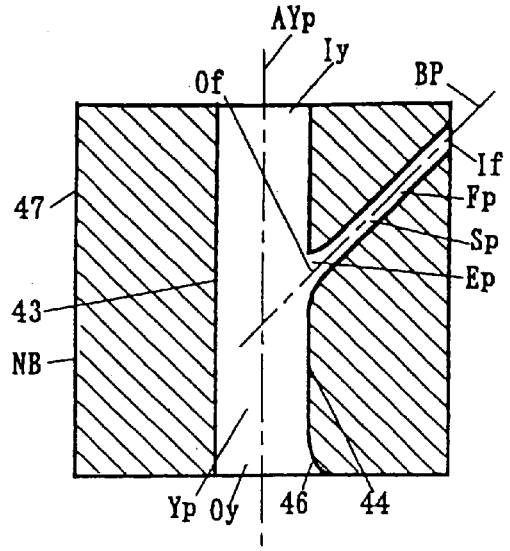
FIG. 25 is a vertical sectional view showing further still another embodiment of the apparatus of the present invention.

FIG. 25 shows an apparatus 47 for fluid treatment of yarn by a nozzle block NB with an expanding outlet 46 expanding only in half the circumference at the yarn outlet Oy portion of the yarn passage Yp, as distinguished from FIGS. 23 and 24. The expanding outlet 46 is formed on the side where the fluid passage Fp is positioned.

Figure 26:
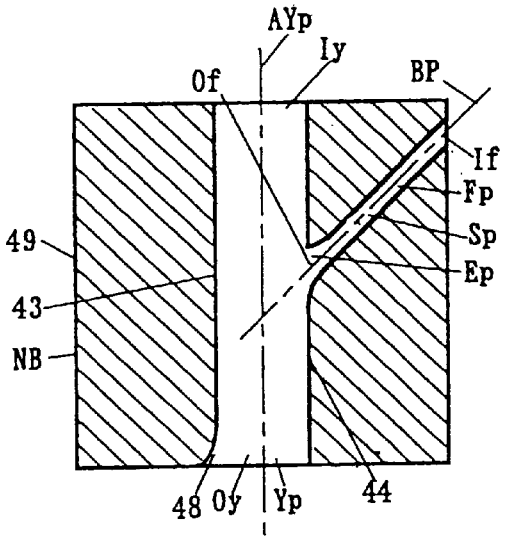
FIG. 26 is a vertical sectional view of yet another embodiment of the apparatus of the present invention.

FIG. 26 shows an apparatus in which the expanding outlet 48 at the yarn outlet Oy portion of the yarn passage Yp is formed on the side opposite to the position of the expanding outlet 46 of the embodiment of FIG. 25, i.e., on the side opposite to the side where the fluid passage Fp is positioned.

The positional relation between the expanding outlet at the yarn outlet Oy portion and the fluid passage Fp is selected based on the intended filament entanglement of the entangled yarn to be produced and used.

Figure 27:
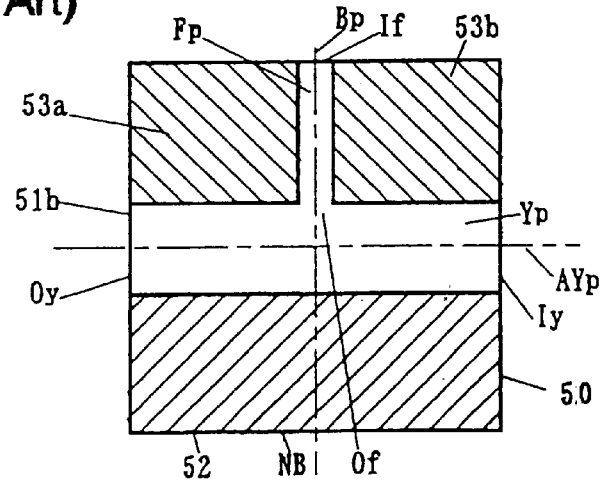
Fig. 27 (Prior Art)
FIG. 27 is a vertical sectional view showing a conventional apparatus for fluid treatment of yarn.

FIG. 27 is a vertical sectional view showing a conventional apparatus 50 for fluid treatment of yarn. The nozzle block NB of the conventional apparatus comprises five pieces.

A right piece and left piece 51 are fastened with a predetermined space between them. A bottom piece 52, a top front piece 53*a* and a top rear piece 53*b* are positioned between the right and left pieces 51*a* and 51*b*. The bottom piece 52 and the top front and top rear pieces 53*a* and 53*b* are positioned with a space between them. The top front piece 53*a* and the top rear piece 53*b* are positioned with a space between them.

The yarn passage Yp is formed as a space surrounded by the surfaces of the right and left pieces 51*a* (not illustrated) and 52*a,* the bottom piece 52 and the top front and top rear pieces 53*a* and 53*b*. One of the front and rear openings of the yarn passage Yp in the outer surface of the nozzle block NB is the yarn inlet Iy and the other is the yarn outlet Oy.

The fluid passage Fp is formed as a space surrounded by the surfaces of the right and left pieces 51 and the top front and top rear pieces 53*a* and 53*b*. The opening of the fluid passage Fp in the outer surface of the nozzle block NB is the fluid inlet If of the fluid passage Fp, and the opening of the fluid passage Fp in the inner wall surface of the yarn passage Yp is the fluid outlet Of of the fluid passage Fp.

A large difference between the conventional apparatus 50 and the apparatus such as FIGS. 1–6 of this invention is that the fluid outlet Of portion of the fluid passage Fp of the conventional apparatus 50 is opened as it is, in the inner wall surface of the yarn passage Yp without expanding in the direction parallel to the axial line of the yarn passage Yp. So, the conventional apparatus 50 for fluid treatment of yarn does not have the action provided by the expanding passage Ep in succession to the straight passage Sp described in connection with FIGS. 1–6.

The fluid outlet Of of the fluid passage Fp may be chamfered at the circumference of the end, to prevent the breaking of filaments of the yarn due to possible contact with the surface of fluid outlet Of while the yarn is being entangled. However, any such chamfering is radically different in purpose and action from the expanding passage Ep in accordance with the present invention.

EXAMPLES

Example 1

As a yarn to be entangled, a polyester yarn of 50 denier having 18 filaments was used. As an entangling device, the device of FIGS. 1 through 6 was used. The fluid jet used was compressed air with a pressure of 0.5 MPa and a flow rate of 130 l/min (standard state). The tension of the yarn supplied into the yarn passage Yp was 20 g. The length Ls of the straight passage Sp was 7.3 mm, and the width WaSp was 0.9 mm. The length Le of the expanding passage Ep was 5.7 mm, and the width WaOf of the expanding passage Ep at the fluid outlet Of was 2.5 mm. As a result, the value of T was 8°. The vertical width of the yarn passage Yp was 2 mm and the horizontal width WtYp was 2 mm. The curve formed by the wall surface of the expanding passage Ep in the reference plane BP was 20 mm in the radius of curvature.

The entangling degree of the entangled yarn obtained was 17.8 (pieces/m). The entangling degree was measured by using an entanglement tester (R-2050 produced by Rosshield) according to the method stated in JIS 1013, and the average value of 50 measurements was adopted.

Example 2

As an entangling device, the device of FIG. 7 was used for entangling a yarn under the following conditions. Adopted parameters were Ls=7.3 mm, WaSp=0.9 mm, Le=5.7 mm, and WaOf=3.1 mm. As a result, the value of T was 11°. The other conditions were the same as in Example 1.

The entangled yarn obtained was 15.3 (piece/m) in entangling degree.

Comparative Example 1

As an entangling device, the conventional device shown in FIG. 27 having no expanding passage Ep was used for entangling a yarn. The other conditions were the same as in Example 1.

The entangled yarn obtained had a degree of entanglement of 8.3 (piece/m) after entangling, measured the same way as in Examples 1 and 2.

Example 3

A yarn was entangled as described in Example 1, except that the width WaOf of the expanding passage Ep was 1.7 mm, to keep the value of T at 4°, and that the curve formed by the wall surface of the expanding passage Ep in the reference plane BP was 50 mm in the radius of curvature.

The entangled yarn obtained had an entangling degree of 1.60 (piece/m).

Example 4

A yarn was entangled as described in Example 1, except that the width WaOf of the expanding passage Ep was 2.1 mm, to keep the value of T at 6°, and that the curve formed by the wall surface of the expanding passage Ep in the reference plane BP was 30 mm in the radius of curvature.

The entangled yarn obtained had an entangling degree of 13.9 (pieces/m).

Example 5

A yarn was entangled as described in Example 1, except that the width WaOf of the expanding passage Ep was 4.5 mm, to keep the value of T at 18°, and that the curve formed by the wall surface of the expanding passage Ep in the reference plane BP was 10 mm in the radius of curvature.

The entangled yarn obtained has an entangling degree of 17.8 (pieces/m).

Example 6

A yarn was entangled as described in Example 1, except that the width WaOf of the expanding passage Ep was 8.9 mm, to keep the value of T at 35°, and that the curve formed by the wall surface of the expanding passage Ep in the reference plane BP was 5 mm in the radius of curvature.

The entangled yarn obtained was measured as having 11.8 (piece/m) entangling degree. In Example 6, since the value of T exceeded 20°, the entangling degree was lower than that in Example 1.

What is claimed is:

1. An apparatus for fluid treatment of yarn comprising a nozzle block, a yarn passage formed in the nozzle block, said yarn passage having a yarn inlet and a yarn outlet in said nozzle block, and having a fluid passage formed in said nozzle block provided with a fluid inlet in the outer surface of said nozzle block and a fluid outlet in an inner wall surface of said yarn passage, wherein said fluid passage comprises a substantially straight passage and an expanding passage communicating with said yarn passage, and wherein (i) said substantially straight passage is formed in such a manner that the area and form of said fluid passage, as viewed in a section crossing the axis line of said fluid passage are substantially constant throughout a range along the axial direction of said fluid passage, and wherein (ii) said expanding passage is positioned downstream of said substantially straight passage and is formed in such a manner that the width of said fluid passage in the direction parallel to a reference line is gradually increased from the end of said substantially straight passage to the fluid outlet in a reference plane, where said reference line is a line parallel to a second axial line; said reference plane is a plane containing a first axial line and said reference line; said first axial line is the axial line of said substantially straight passage; and said second axial line is the axial line of the yarn passage, and further wherein (iii) the length of said substantially straight passage in the direction of said first axial line in said reference plane, the width at the end of said substantially straight passage in the direction parallel to said reference line, and the length of said expanding passage in the direction of said first axial line satisfy the following formula (I):

$$Ls > Le > 2 \times WaSp \quad (I)$$

wherein Ls represents the length of said substantially straight passage, Le represents the length of said expanding passage, and WaSp represents the width at the end of said substantially straight passage.

2. An apparatus for fluid treatment of yarn according to claim 1, wherein the maximum width of said fluid outlet in the direction perpendicular to said reference plane is substantially equal to the maximum width of said yarn passage in the same direction.

3. An apparatus for fluid treatment of yarn according to claim 1, wherein the width at the end of said substantially straight passage in the direction parallel to said reference line, the length of said expanding passage in the direction of said first axial line, and the width of said fluid outlet in the direction parallel to said reference line in said reference plane satisfy the following formula (II):

$$0° < \tan^{-1}\{(WaOf - WaSp)/(2 \times Le)\} < 20° \quad \text{(II)},$$

wherein WaOf represents the width of the fluid outlet.

4. An apparatus for fluid treatment of yarn according to claim 1, wherein said reference line agrees with said second axial line.

5. An apparatus for fluid treatment of yarn according to claim 4, wherein the form of the cross section of said fluid passage in a plane perpendicular to said reference plane and parallel to the direction of said reference line is substantially rectangular, and wherein the form of the cross section of said yarn passage in a plane perpendicular to said reference plane and perpendicular to the direction of said reference line is substantially rectangular.

6. An apparatus for fluid treatment of yarn according to claim 1, wherein the cross-sectional area of said yarn passage in a plane perpendicular to said second axial line expands at least at either of the yarn inlet portion containing said yarn inlet or the yarn outlet portion containing said yarn outlet.

7. A yarn composed of entangled multifilament produced by an apparatus for fluid treatment of yarn as claimed in any one of claims 1 through 6.

8. An apparatus for fluid treatment of yarn which comprises a nozzle block, a yarn passage formed in said nozzle block and having a yarn inlet and a yarn outlet in said nozzle block, and a fluid passage formed in said nozzle block and having a fluid inlet in the outer surface of said nozzle block and a fluid outlet in an inner wall surface of said yarn passage, the combination wherein said fluid passage comprises:

(i) a substantially straight passage in which a first distance is substantially constant throughout a range along said fluid passage, where said first distance is a distance in the direction of a first perpendicular from a first axial line to a wall surface of said fluid passage; said first perpendicular is a line perpendicular to said first axial line; and said first axial line is the axial line of said fluid passage, and (ii) an expanding passage in which a second distance is gradually increased from the end of said substantially straight passage to said fluid outlet at least in either the direction of said yarn inlet or the direction of said yarn outlet, where said second distance is a distance in the direction of a second perpendicular from said first axial line to the wall surface of the fluid passage; said second perpendicular is a line perpendicular to said first axial line in a reference plane; said reference plane is a plane containing said first axial line and a reference line; said reference line is a line parallel to a second axial line; and said second axial line is the axial line of said yarn passage, and wherein (iii) the maximum width of said fluid outlet in the direction perpendicular to said reference plant is substantially equal to the maximum width of said yarn passage in the same direction.

9. A yarn composed of entangled multifilament, produced by an apparatus for fluid treatment of yarn claimed in any of claims 8 and 10 through 12.

10. An apparatus for fluid treatment of yarn according to claim 8, wherein said reference line agrees with said second axial line.

11. An apparatus for fluid treatment of yarn according to claim 10, wherein the form of the cross section of said fluid passage in a plane perpendicular to said reference plane and parallel to the direction of said reference line is substantially rectangular, and wherein the form of the cross section of said yarn passage in a plane perpendicular to said reference plane and perpendicular to the direction of said reference line is substantially rectangular.

12. An apparatus for fluid treatment of yarn according to claim 8, wherein the cross-sectional area of said yarn passage in a plane perpendicular to said second axial line expands at least at either of the yarn inlet portion containing said yarn inlet or the yarn outlet portion containing said yarn outlet.

* * * * *

UNITED STATES PATENT AND TRADEMARK OFFICE

CERTIFICATE OF CORRECTION

PATENT NO. : 6,134,759
DATED : October 24, 2000
INVENTOR(S) : Saijo et al

It is certified that error appears in the above-identified patent and that said Letters Patent is hereby corrected as shown below:

In column 3, at line 53, please change "nay" to --may--.

In column 5, at line 39, please change "nay" to --may--; and at line 42, please change "T)≤20°" to --T)≥20°--.

Signed and Sealed this

Eighth Day of May, 2001

*Attest:*

Nicholas P. Godici

NICHOLAS P. GODICI

*Attesting Officer*

*Acting Director of the United States Patent and Trademark Office*